US006857893B1

(12) United States Patent
Patterson

(10) Patent No.: US 6,857,893 B1
(45) Date of Patent: Feb. 22, 2005

(54) ELECTRICAL CONNECTOR WITH A LOW PROFILE LATCH

(75) Inventor: Jeremy Christin Patterson, Mcleansville, NC (US)

(73) Assignee: Tyco Electronics Corporation, Middleton, PA (US)

( * ) Notice: Subject to any disclaimer, the term of this patent is extended or adjusted under 35 U.S.C. 154(b) by 0 days.

(21) Appl. No.: 10/716,296

(22) Filed: Nov. 18, 2003

(51) Int. Cl.[7] ..... H01R 13/627
(52) U.S. Cl. ..... 439/385; 439/374
(58) Field of Search ..... 439/358, 374, 439/929, 357, 354

(56) References Cited

U.S. PATENT DOCUMENTS 6,514,099 B2 * 2/2003 Endo ..... 439/489
2002/0119693 A1 * 8/2002 Chen ..... 439/358

* cited by examiner

*Primary Examiner*—Phuong Dinh

(57) ABSTRACT

An electrical connector includes a housing having a mating face that is configured to be mounted onto an electrical connector interface. A latch assembly is provided on a side wall of the housing. The latch assembly is oriented to extend along the side wall and has a latch element formed on an end thereof proximate the mating face. The latch assembly includes pivot posts at an intermediate point along a length of the latch assembly. The pivot posts pivotally join the latch assembly to the side wall.

20 Claims, 4 Drawing Sheets

ELECTRICAL CONNECTOR WITH A LOW PROFILE LATCH

BACKGROUND OF THE INVENTION

The present invention relates generally to electrical connectors and particularly to an electrical connector with a low profile latch.

Electrical connectors have been proposed with various features to afford secure mechanical and electrical engagement with a mating electrical connector or other mateable connecting device. Various latching systems have been used with electrical connectors to provide such secure engagement. It is desirable that the latch providing the secure engagement also afford easy attachment and detachment. For instance, latching mechanisms have been developed which include pivotally supported latching arms that interlock with each other or that interlock with a complementary latching mechanism of the mateable connector or connecting device. The latching arms of many connectors are pivotally mounted on the connector housings and often require a relatively long lever arm portion to pivot the latching arm to either engage or disengage the arm from a latch on the mating connecting device. This requires considerable space on the connector assembly which renders such connectors unsuitable for spatially constrained applications such as seat motor interfaces in automobiles.

In the automotive industry, heretofore, space constraints have prevented the use of a releasable latch at the connector that joins the seat electronics to the vehicle. Hence, seat connectors have employed a non-serviceable connection whereby the primary connector, once mated, is not intended to be disconnected. This usually results when space constraints render the primary connector either totally inaccessible or where there is not sufficient space for the connector to be manipulated as needed to perform a disconnect without damaging the connector. In such applications, a secondary connection has been provided in a manner and location that is serviceable. The secondary connection can be disconnected to accommodate service and repair activities. Secondary connections are provided in applications where space is limited, such as in automotive seat applications. More specifically, the seat adjusting mechanism is driven by an electric motor which can only be serviced after removing the seat. Due to space limitations, a secondary serviceable connection is typically used to facilitate the removal of the seat. However, the use of secondary connections adds to product cost.

A need exists for a connector with a low profile latch for use in applications with close space constraints such as seat motor connections.

BRIEF DESCRIPTION OF THE INVENTION

In one embodiment of the invention, an electrical connector is provided that includes a housing having a mating face that is configured to be mounted onto an electrical connector interface. A latch assembly is provided on a side wall of the housing. The latch assembly is oriented to extend along the side wall. The latch assembly has a latch element formed on an end thereof proximate the mating face and includes a pivot post at an intermediate point along a length of the latch assembly. The pivot post pivotally joins the latch assembly to the side wall.

In another embodiment of the invention, an electrical connector is provided that includes a housing having a mating face that is configured to join an electrical connector interface. A shroud is provided on a side wall of the housing and has an outer flange spaced from the side wall to define a gap therebetween. A pivotable latch assembly is provided on the side wall of the housing and is oriented to extend along the side wall. The latch assembly has a latch element formed on an end thereof proximate the mating face. At least a forward portion of the latch assembly is located within the gap and is pivotable between the shroud and the side wall.

DETAILED DESCRIPTION OF THE INVENTION

Figure 1:
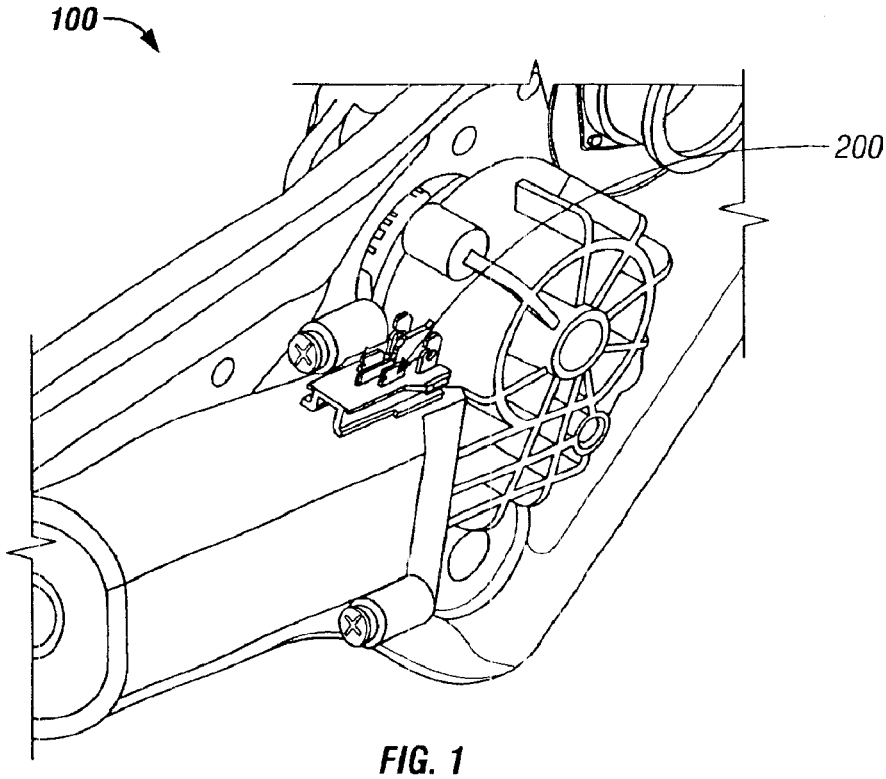
FIG. 1 (Prior Art)
FIG. 1 is a partial perspective view of a seat motor for an automotive application.

FIG. 1 illustrates a seat motor 100 that is a height adjust motor and is used in an area of limited space on an automobile. Seat motor 100 includes a connector interface 200.

Figure 2:
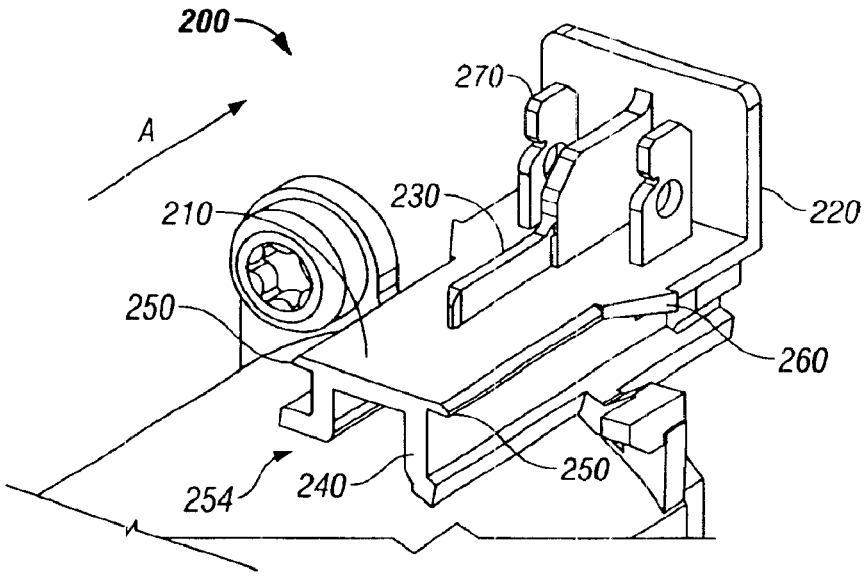
FIG. 2 (Prior Art)
FIG. 2 is a perspective view of an electrical interface for the seat motor of FIG. 1.

FIG. 2 shows the connector interface 200 in greater detail which includes a base 210, a back wall 220, and a support rib 230 centrally located on base 210. A pair of contacts 270 upwardly extend from base 210 proximate back wall 220. Base 210 has flanges 260 outwardly projecting from each side thereof. Base 210 includes wing portions 250 on each side that extend from a rearward end 254 of the base 210 to the flange 260. For purposes of illustration, the term forward shall refer to a direction denoted by arrow A from the rear end 254 toward back wall 220 of connector interface 200. The connector interface 200 includes rails 240 that sit on a frame of the seat.

Figure 3:
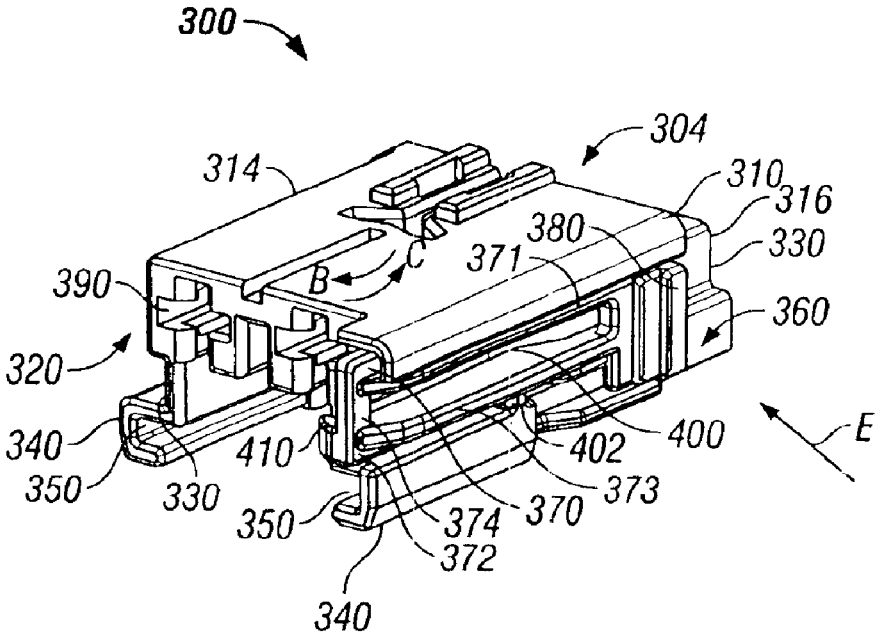
FIG. 3 is a front perspective view of an electrical connector formed in accordance with an embodiment of the present invention to join the electrical interface shown in FIG. 3.

FIG. 3 illustrates a connector 300 formed in accordance with an embodiment of the present invention for use with connector interface 200. Connector 300 includes a housing 304 formed with a top wall 314 and side walls 330. An upper shroud 310 extends laterally from one side of top wall 314 and projects outward over an upper portion of one of side walls 330. The outer edge of upper shroud 310 folds down to form a flange 316. The connector 300 has a mating face 320 that includes a number of contact cavities 390. The mating face 320 is configured to join the connector interface 200 (FIG. 2) such that contact cavities 390 accept the contacts 270. The contact cavities 390 include contacts (not shown) that join contacts 270. A pair of alignment shrouds 340 are formed along the lower edges of the side walls 330 proximate the mating face 320. The alignment shrouds 340 include channels 350 facing one another and extending in a direction parallel to the side walls 330. The channels 350 slidably accept the wing portions 250 (FIG. 2) on the base 210 to properly align the connector 300 and the connector interface 200.

A latch assembly 360 is attached to one side wall 330 of connector 300 below upper shroud 310. The latch assembly 360 is oriented with a longitudinal axis of the latch assembly 360 extending along a length of the side wall 330. The latch assembly 360 includes parallel upper and lower beams 370 and 372 which extend along the side wall 330. Upper beam 370 includes a stiffening rib 371 that extends along a length of the upper beam 370. Similarly, the lower beam 372 includes a stiffening rib 373 that likewise extends along a length of the lower beam 372. Intermediate portions of the upper and lower beams 370 and 372 are joined to the side wall 330 through corresponding upper and lower pivot posts 400 and 402. The upper and lower beams 370 and 372 have lead ends that project beyond the mating face 320 and are joined by a cross bar 374. The cross bar 374 includes a latch element 410 that is directed inward laterally to a position overlapping the mating face 320. The stiffening ribs 371 and 373 are provided to increase the stiffness of the upper and lower beams 370 and 372 thereby reducing an amount of deflection at the cross bar 374 so that the possibility of inadvertent disengagement of the latch element 410 from the interface back wall 220 (see FIG. 2) is reduced when the connector 300 is latched to the interface 200. A grip element 380 is provided at an end of the latch assembly 360 opposite to the latch element 410. The shroud 310 extends along at least a portion of latch assembly 360 in an overlapping fashion. The shroud 310 and corresponding alignment shroud 340 cooperate to prevent damage to the latch assembly 360.

Figure 4:
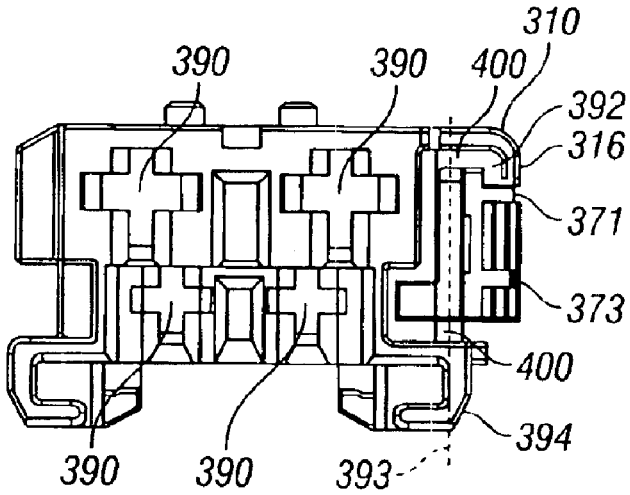
FIG. 4 is a front view of the mating face of the connector of FIG. 3.
Figure 5:
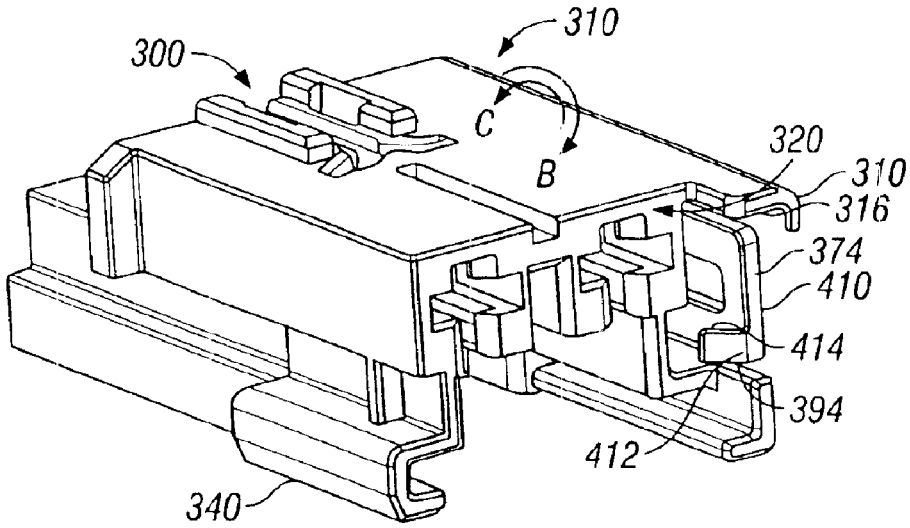
FIG. 5 is a rear perspective view of a connector formed according to an embodiment of the present invention

FIGS. 4 and 5 illustrate the mating face 320 of connector 300. The upper shroud 310 and flange 316 extend outward and down from side wall 330 to create a latch operating gap 392. The upper and lower pivot posts 400 and 402 integrally join upper and lower beams 370 and 372 to side wall 330 to be pivotable laterally in the directions of arrows B and C (see FIGS. 3 and 5), inward and outward toward and away from the mating face 320. The upper and lower beams 370 and 372 pivot within gap 392 over a range of movement limited by side wall 330 and flange 316. Latch element 410 extends from the cross bar 374 toward mating face 320 while grip portion 380 extends in the opposite direction. Grip portion 380 is normally biased outward away from side wall 330 and, when pivoted inward toward side wall 330, causes the upper and lower beams 370 and 372 to move the latch element 410 to a released position. Latch assembly 360 pivots within gap 392 about a rotational axis 393 (FIG. 4) through pivot posts 400 and 402. The rotational axis 393 extends transversely through latch assembly 360 at an intermediate point along the length of the latch assembly 360. Gap 392 is oriented perpendicularly to the rotational axis 393.

Figure 6:
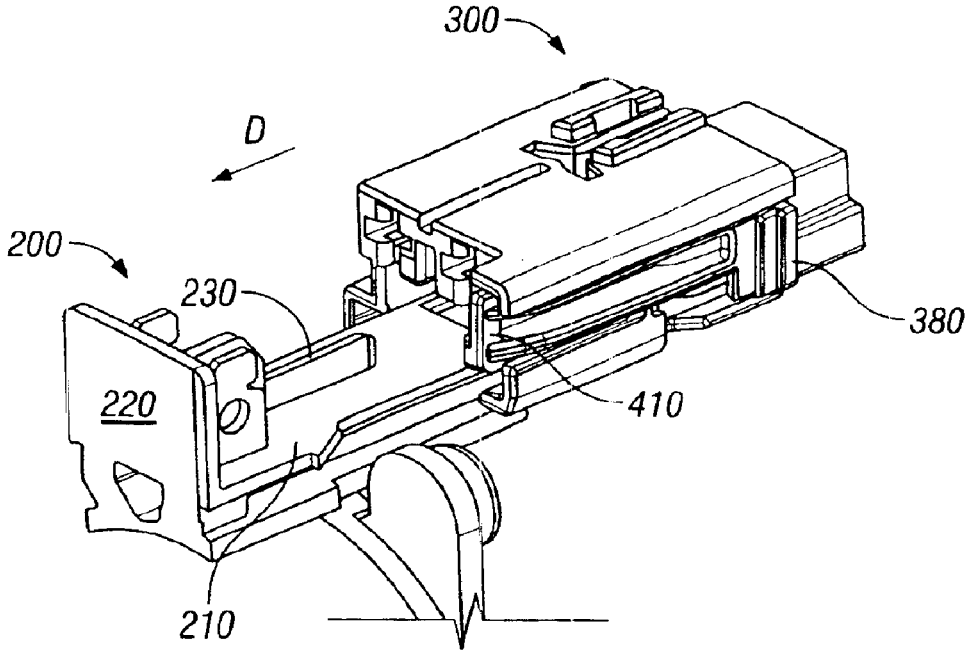
FIG. 6 is a perspective view of a connector formed according to an embodiment of the present invention aligned for mating with a seat motor interface.
Figure 7:
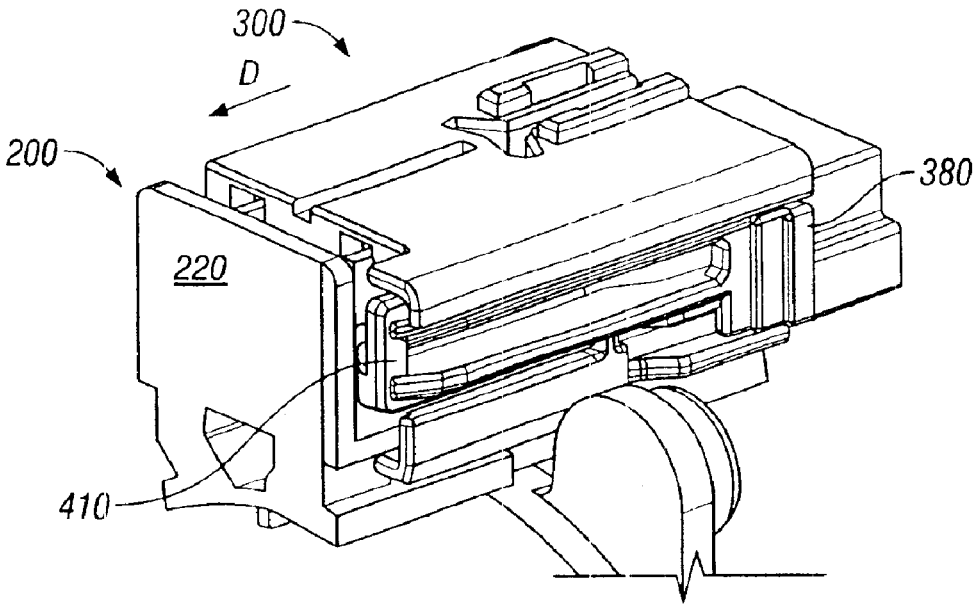
FIG. 7 is a perspective view of a connector formed according to an embodiment of the present invention partially mated to a seat motor interface.
Figure 8:
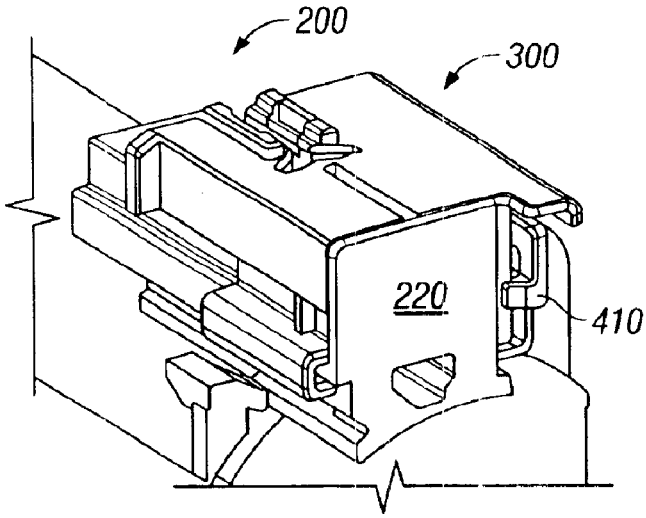
FIG. 8 is a perspective view of a connector formed according to an embodiment of the present invention fully mated to a seat motor interface.

The mating operation of connector 300 with connector interface 200 is shown progressively in FIGS. 6 through 8 and discussed hereafter. In FIG. 6, connector 300 is positioned on base 210 of connector interface 200 at an initial position. Connector 300 is then advanced in the direction of arrow D (FIG. 6) toward back wall 220 of interface 200 until latch element 410 contacts back wall 220 as represented in FIG. 7. At the point shown in FIG. 7, connector 300 and interface 200 are partially mated. However, latch element 410 is not fully engaged on the back surface of back wall 220. In FIG. 8, connector 300 is advanced until latch element 410 is fully engaged on the back surface of back wall 220 at which position the mating operation is completed. The latch element 410 includes a beveled front surface 412 (FIG. 5) which rides outward and over the back wall 220 to facilitate the latching operation. A stop surface 414 (FIG. 5) on the latch element 410 hooks over the back wall 220.

To separate connector 300 from interface 200, pressure is applied to grip portion 380 in the direction of arrow E (FIG. 3) which causes beams 370 and 372 to pivot in the direction of arrow C, thereby moving latch element 410 out of engagement with back wall 220 (e.g., to a non-overlapping position with mating face 320) thus allowing connector 300 to be withdrawn from interface 200.

The embodiments thus described provide a low profile electrical connector for use in limited space applications. The connector includes a releasable latch that facilitates disengagement of the connector while assuring positive engagement of the connector and connector interface when mated. The connector affords a serviceable primary connection eliminating the need for secondary serviceable connections for applications such as automotive seat motor connections.

While the invention has been described in terms of various specific embodiments, those skilled in the art will recognize that the invention can be practiced with modification within the spirit and scope of the claims.

What is claimed is:

1. An electrical connector, comprising:

a housing having a mating face that is configured to be mounted onto an electrical connector interface;

a latch assembly provided on a side wall of said housing, said latch assembly being oriented to extend along said side wall, said latch assembly having a latch element formed on an end thereof proximate said mating face, said latch assembly including a pivot post at an intermediate point along a length of said latch assembly, said pivot post pivotally joining said latch assembly to said side wall; and a shroud extending outward from said side wall, said shroud having a flange spaced apart from said side wall to define a latch operating gap therebetween, said latch assembly including a beam extending alone said latch operating gap, said beam pivoting laterally within said latch operating gap.

2. The electrical connector of claim 1, wherein said latch assembly includes upper and lower beams extending along said side wall and includes upper and lower pivot posts integrally joining said upper and lower beams, respectively, to said side wall.

3. The electrical connector of claim 1, wherein said latch assembly includes at least one beam projecting forward from said pivot post toward said mating face and a grip portion projecting rearward from said pivot post.

4. The electrical connector of claim 1, wherein said latch assembly pivots about a rotational axis at said pivot post, said rotational axis extending transversely through said latch assembly at an intermediate point along said length of said latch assembly.

5. The electrical connector of claim 1, further comprising a shroud provided along at least a portion of said side wall, said shroud extending along at least a portion of said latch assembly in an overlapping relation.

6. The electrical connector of claim 1, further comprising a shroud provided on said housing, said shroud overlapping at least a portion of said latch assembly located between said pivot post and said mating face.

7. The electrical connector of claim 1, further comprising upper and lower shrouds provided on said housing above and below said latch assembly, at least one of said upper and lower shrouds overlapping a portion of said latch assembly, said portion of said latch assembly abutting against said at least one of said upper and lower shrouds to limit a range of pivotal motion of said latch assembly.

8. The electrical connector of claim 1, wherein said latch assembly includes a beam that pivots inward and outward toward and away from said side wall, said connector further comprising a shroud extending beyond and partially covering said beam.

9. The electrical connector of claim 1, wherein said latch assembly includes a grip portion that is normally biased outward away from said side wall by said pivot post, said grip portion being pivotal inward toward said side wall to release said latch element.

10. An electrical connector, comprising:

a housing having a mating face that is configured to join an electrical connector interface;

a shroud provided on a side wall of said housing, said shroud having an outer flange spaced from said side wall to define a gap therebetween; and a latch assembly pivotally provided on said side wall, said latch assembly being oriented to extend along said side wall, said latch assembly having a latch element formed on an end thereof proximate said mating face, at least a forward portion of said latch assembly being located within said gap and being pivotal between said shroud and said side wall.

11. The electrical connector of claim 10, wherein a length of said latch assembly extends along a length of said side wall, said latch assembly including a pivot post joined to said side wall, said forward portion of said latch assembly rotating laterally within said gap about said pivot post.

12. The electrical connector of claim 10, wherein said latch assembly includes upper and lower beams extending along said side wall and includes upper and lower pivot posts integrally joining said upper and lower beams, respectively, to said side wall, one of said upper and lower beams extending along, and pivotally rotating transversely within, said gap.

13. The electrical connector of claim 1, wherein said latch assembly includes a pivot post joining said latch assembly to said side wall, said latch assembly further comprising at least one beam projecting forward from said pivot post toward said mating face and a grip portion projecting rearward from said pivot post.

14. The electrical connector of claim 10, wherein said latch assembly pivots about a rotational axis extending transversely through said latch assembly at an intermediate point along said length of said latch assembly, said forward portion laterally moving within said gap, said gap being oriented perpendicular to said rotational axis.

15. The electrical connector of claim 10, wherein said shroud has a flange spaced apart from said side wall to define said gap as a latch operating gap, said latch assembly including a beam extending along said latch operating gap, said beam pivoting laterally within said latch operating gap.

16. The electrical connector of claim 10, wherein said shroud does not overlap a rear portion of said latch assembly, said rear portion having a grip surface that is pressed toward said side wall to release said latch element.

17. The electrical connector of claim 10, further comprising upper and lower shrouds provided on said housing above and below said latch assembly, at least one of said upper and lower shrouds overlapping said forward portion of said latch assembly, said forward portion of said latch assembly abutting against said at least one of said upper and lower shrouds to limit a range of pivotal motion of said latch assembly.

18. The electrical connector of claim 10, wherein said latch assembly includes a beam that pivots inward and outward toward and away from said side wall, said shroud extending beyond and partially covering said beam.

19. The electrical connector of claim 10, wherein said latch assembly includes a grip portion that is normally biased outward away from said side wall by a pivot post joining said latch assembly to said side wall, said grip portion being pivotal inward toward said side wall to release said latch element.

20. An electrical connector, comprising:

a housing having a mating face that is configured to be mounted onto an electrical connector interface, said housing including opposed channels at lower side edges proximate said mating face and an open bottom therebetween; and a latch assembly provided on a side wall of said housing, said latch assembly being oriented to extend along said side wall, said latch assembly having a latch element formed on an end thereof proximate said mating face, said latch assembly including a pivot post at an intermediate point along a length of said latch assembly, said pivot post pivotally joining said latch assembly to said side wall.

* * * * *